US005235392A

United States Patent [19]

Hediger

[11] Patent Number: 5,235,392

[45] Date of Patent: Aug. 10, 1993

[54] REPRODUCTION APPARATUS HAVING IMAGE TRANSFER VELOCITY MATCHING MEANS

[75] Inventor: Edwin A. Hediger, Fairport, N.Y.

[73] Assignee: Eastman Kodak Comany, Rochester, N.Y.

[21] Appl. No.: 894,990

[22] Filed: Jun. 8, 1992

[51] Int. Cl.[5] ..... G03G 15/14

[52] U.S. Cl. ..... 355/271; 355/203; 355/204; 355/208; 355/272; 346/157

[58] Field of Search ..... 355/203, 204, 208, 271, 355/272, 277, 326, 327; 346/157; 430/42, 357, 126

[56] References Cited

U.S. PATENT DOCUMENTS

| | | | |
|---|---|---|---|
| 4,541,709 | 9/1985 | Kampschreur | 430/126 X |
| 4,723,145 | 2/1988 | Takada et al. | 355/326 X |
| 4,733,269 | 3/1988 | Kasahara et al. | 430/357 X |
| 4,937,635 | 6/1990 | Paxon et al. | 355/326 |
| 4,947,209 | 8/1990 | Maeno et al. | 355/204 |
| 4,963,899 | 10/1990 | Resch, III | 463/157 |
| 4,975,741 | 12/1990 | Tanaka | 355/208 X |
| 4,994,827 | 2/1991 | Jamzadeh et al. | 346/157 |
| 5,021,829 | 6/1991 | Johnson et al. | 355/271 X |
| 5,021,835 | 6/1991 | Johnson | 355/271 |
| 5,043,761 | 8/1991 | Johnson et al. | 355/271 X |
| 5,130,748 | 7/1992 | Tanaka | 355/208 X |

*Primary Examiner*—A. T. Grimley
*Assistant Examiner*—Matthew S. Smith
*Attorney, Agent, or Firm*—Tallam I. Nguti

[57] ABSTRACT

A reproduction apparatus that has an image-bearing member and an image transfer member includes a first drive assembly for driving the image-bearing member at a desired process velocity V1, and a second and separate drive assembly, including a DC servo motor, for driving the image transfer member in synchronization with the image-bearing member. The reproduction apparatus also includes a mechanism for engaging and disengaging the DC servo motor relative to the transfer member, first and second encoders for measuring in encoder counts the movements of the transfer member and of the image-bearing member, and controls including a logic and control unit that is connected to the encoders and to the servo motor for monitoring and controlling the operations of the reproduction apparatus. The reproduction apparatus further includes passive assembly for moving the transfer member at the process velocity when the servo motor is disengaged from the transfer member.

10 Claims, 3 Drawing Sheets

REPRODUCTION APPARATUS HAVING IMAGE TRANSFER VELOCITY MATCHING MEANS

BACKGROUND OF THE INVENTION

Field of the Invention

This invention relates to such electrostatographic reproduction apparatus as copiers and printers. More particularly, this invention relates to such a copier or printer that includes means for matching, during image transfer, the velocities of the image transferring and image receiving surfaces therein.

Background Art

Electrostatographic reproduction apparatus including color copiers and printers are well known. As disclosed, for example, in U.S. Pat. No. 4,796,054, issued Jan. 3, 1989 to Maeno et al, U.S. Pat. No. 4,872,037, issued Oct. 3, 1989 TO Kasahara et al., and U.S. Pat. No. 5,040,026, issued Aug. 13, 1991 to Jamzadeh et al., color copiers and printers produce or reproduce copies of multicolor originals. To do so, electrostatic latent images of a plurality of separated color components of a multicolor original are formed on a moving image-bearing member. Each of such latent images is developed with a complementary color toner, and the developed images are then transferred sequentially, in superimposed registration, from the image-bearing member to a receiving surface on a moving transfer member. As discussed, in each of the above patent references, in order to produce high-quality image transfers, there is a great need in each such copier or printer to provide effective means for achieving precise registration between the starting and ending points of an image to be transferred and those of the image-receiving surface of the transfer member.

Unfortunately, however, the registration and quality of the transferred images in such a color copier or printer can be detrimentally affected by other factors such as fluttering of the image-transferring surface, unequal image lengths among separated color component images to be registered caused for example by a slave driven transfer member, and mismatched velocities between the image-transferring surface of the image-bearing member and the image-receiving surface of a transfer member.

SUMMARY OF THE INVENTION

It is, therefore, an object of the present invention to provide on electrostatographic reproduction apparatus in which fluttering of the image-bearing member is significantly reduced.

It is also an object of the present invention to provide an electrostatographic reproduction apparatus including an image transfer station and means for matching the velocities thereat of the image-transferring and receiving surfaces.

In accordance with the present invention, an electrostatographic reproduction apparatus is provided and includes a movable image-bearing member including an image-transferring surface, and a movable transfer member including an image-receiving surface. The reproduction apparatus includes first means for driving the image-bearing member at a desired process velocity V1, and second and separate means including a DC servo motor for driving the transfer member relative to the image-bearing member. The reproduction apparatus also includes means for engaging and disengaging the DC servo motor relative to the transfer member, first and second encoders for measuring in encoder counts the movements of the transfer member and image-bearing member, and control means including a logic and control unit that is connected to the encoders and to the servo motor for monitoring and controlling the operations thereof. The reproduction apparatus further includes passive means for moving the transfer member at the process velocity when the servo motor thereto is disengaged from said transfer member.

The invention, and its objects and advantages, will become more apparent in the detailed description of the preferred embodiment presented below.

BRIEF DESCRIPTION OF THE DRAWINGS

In the detailed description of the preferred embodiment presented below, reference is made to the drawings in which.

BEST MODE OF CARRYING OUT THE INVENTION

Because electrostatographic reproduction machines and development apparatus for use therein are well known, the present description will be directed in particular to elements thereof which form part of or cooperate more directly with the present invention. Elements thereof not specifically shown or described herein are assumed selectable from those known in the prior art.

Figure 1:
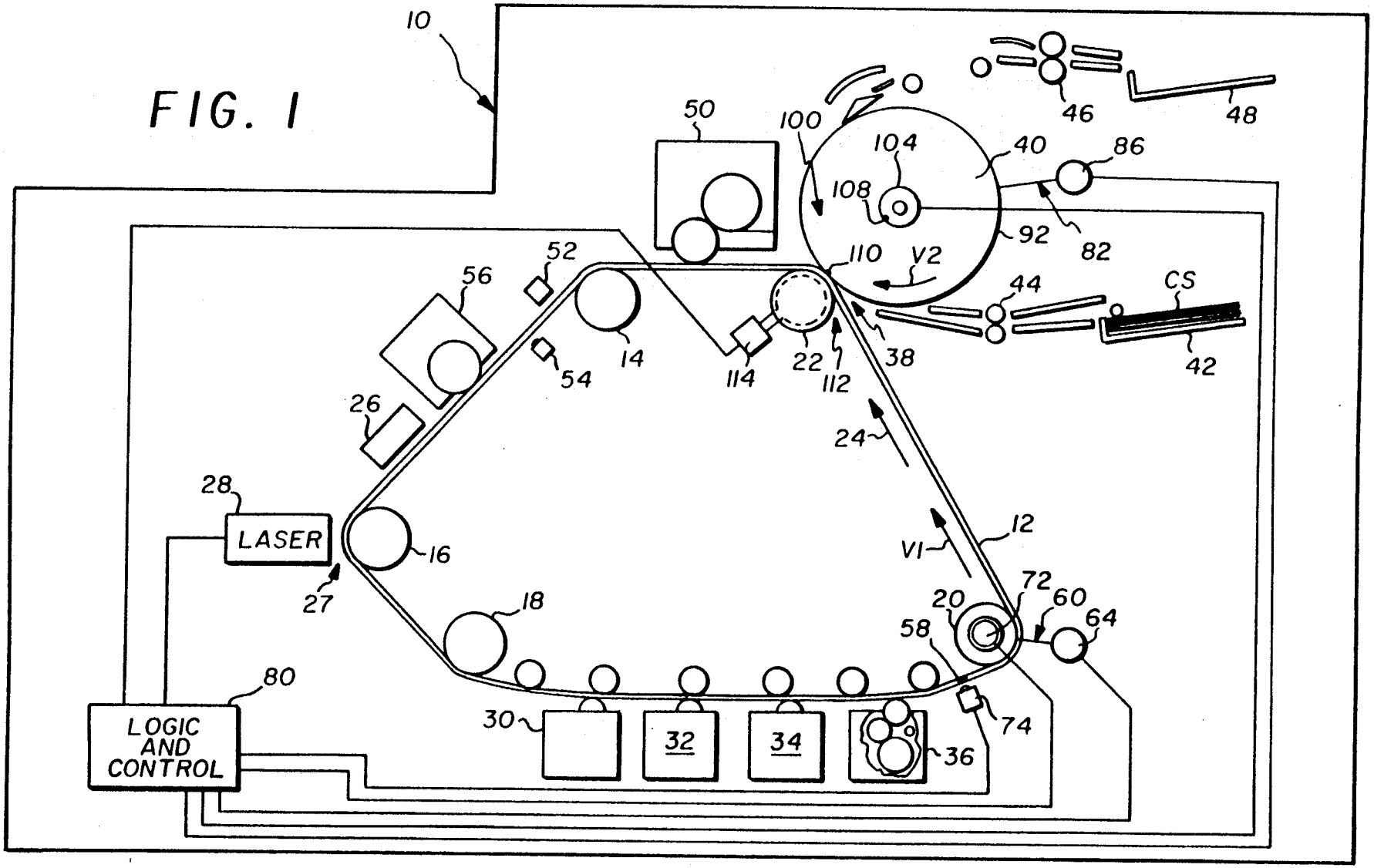
FIG. 1 is a schematic of an electrostatographic reproduction apparatus including the means of the present invention.

According to FIG. 1 a reproduction apparatus 10 is designated and is suitable for making color separation images of a multicolor original for example from electronic input. An electrophotographic image-bearing member or PC shown as a web 12 is trained about a series of rollers such as the rollers 14, 16, 18, 20 and 22, including an exposure station roller 16. The web 12 is driven at a desired process velocity V1 for example by the roller 20 in a counterclockwise direction, as indicated by the arrow 24, past a series of process stations. The electrophotographic web 12 commonly includes one or more photoconductive layers, a conductive layer and a support layer. It may also include insulating layers, barrier layers and other layers well-known in the art.

For image formation, each portion of the moving web 12 is charged at a charging station 26, and exposed at an exposing station 27 including, for example, a polygon laser scanner 28 to create an electrostatic image on the web 12. The electrostatic image is next toned at one of a series of toning stations shown as 30, 32, 34 and 36 in order to create a toner image. The toner image is then transferred to a receiving sheet CS at a transfer station 38 that includes a roller (referred to as a transfer roller TR in FIG. 3) or drum transfer member of the present invention shown as 40 which includes an elastomeric layer (not shown). The receiving sheet CS is fed from a supply 42 thereof by means 44. After such image transfer, the sheet CS, carrying the transferred image, is separated from the web 12 and from the transfer member 40, and then transported to a fuser station 46 where the toner image is fused and fixed to the sheet CS. The sheet CS is then fed to a receiving tray 48, or other output accessory all as is well known in the art.

Each portion of the web 12 so used is then prepared for formation of the next image. For such preparation, the portion is first cleaned by a cleaning device at a cleaning station 50. Residual charge is then eliminated by an auxiliary charger 52 and by an erase lamp 54. A lubricant may be added to the web 12 at a lubricant applicator 56, and the web is then ready for reuse.

Although FIG. 1 shows a transfer station 38 at which a receiving sheet CS is presented directly to the toner image for example repeatedly to the color separation images (of an original) on web 12, it is noted that this invention can also be used in known systems in which such toner images are transferred instead directly to the surface of the transfer member, for example, to that of a drum or endless web transfer member, and thereafter then transferred to the receiving sheet CS.

The exposing station 27 includes for example the polygon laser scanner 28 capable of extremely high resolution, for example, 1200 to 2400 dots per inch. It receives input from a scanner, computer or memory, not shown, which input represents the color separations of a desired multicolor image to be formed using the separations produced by this apparatus. For example, a color original may have been scanned, with the scanner capable of converting the information in that original to signals representative of the red, green and blue components of the original. With appropriate image processing, those signals are converted into signals representing the cyan, magenta, yellow and black color separations of the final copy. These signals are then fed to the laser scanner 28 at the exposing station 27. The exposure station 27 then forms four latent electrostatic images representative of these color separations and these latent images are then developed with the appropriate color toner at the appropriate toning or development station 30–36. Thereafter, the visible toner separation images are transferred in registration at the transfer station 38 to a copy sheet CS.

In order to have high quality copies, such image-to-image registration must be accurate enough to obtain a final multicolor image copy in which the colors are tightly in register. More specifically, to utilize the high resolution of a laser scanner producing 1200 to 2400 dots per inch requires such registration must be sufficiently accurate so that points in consecutive color separation images corresponding to a single point on the original all fall within a 60 micron diameter circle of each other.

Figure 2:
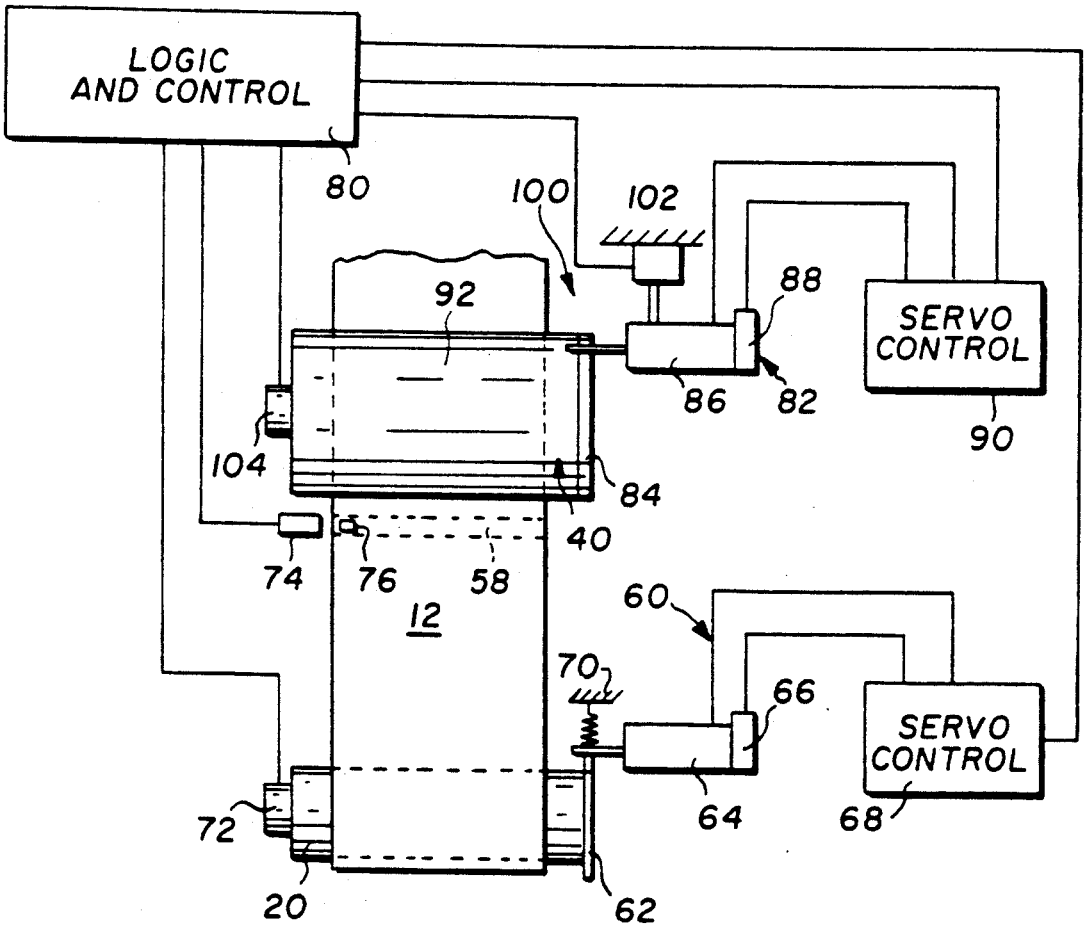
FIG. 2 is a block diagram of a part of FIG. 1 showing the drives and transfer member of the present invention.

Referring now to FIGS. 1 and 2, the image-bearing member 12 is a flexible member that is jointed at a splice point shown as 58 and is divisible into imaging frame segments and non-image interframe segments. The member 12 is driven along a closed path that is defined in part by a plurality of rollers which include principally an exposure station roller 16, roller 18, a transfer station roller 22, and the drive roller 20. In order to improve imaging quality, and in order to reduce fluttering of the flexible member 12, particularly at process stations such as the exposure station 27 and the transfer station 38, the path defining rollers such as the exposure roller 16, the roller 18, the drive roller 20, and transfer roller 22 (during image transfer), each has a fixed non-shiftable position. In addition, the circumference of each principal roller about which the web 12 is trained, for example the drive roller 20, is made substantially equal to the sum of the intrack dimensions of one image frame segment and one interframe segment of the image-bearing member 12.

As shown, the drive roller 20 is positioned between the exposure and transfer stations 27, 38 for frictionally driving the image-bearing member 12. In order to further reduce any fluttering of the flexible member 12, the drive roller 20 is driven at the process velocity V1 (referred to as a process speed PS in FIG. 3) by a first friction drive system 60 that includes a friction drive disk 62 which is mounted fixedly to the drive roller 20 for rotation therewith. The drive system 60 also includes a first DC servo motor assembly comprising a DC motor 64 for driving the disk 62 at a desired constant velocity, an encoder 66 mounted to the motor 64 and a servo controller 68 that is connected to the encoder 66 and to the motor 64 for maintaining the velocity of the motor at the desired constant speed. The drive system 60 further includes loading means such as a spring 69 for biasing the drive pin 70 of the motor 64 against the drive disk 62.

As further shown, for measuring the movement of the image-bearing member 12, the reproduction apparatus 10 includes a first encoder shown as 72 that is mounted to the drive roller 20. A sensor 74 is mounted along the closed path of the moving member 12 for sensing a single splice-marking perf 76, which sensing event can be used for timing the measuring of movement as above by the first encoder 72.

For monitoring and controlling the operations of the various process stations and the various elements of the apparatus, a logic and control unit (LCU) shown generally as 80 is connected variously as required to such stations and elements. The LCU 80 for example includes input/output circuit boards, a bus structure consisting of a series of address, data and control signal lines, and a central processing unit (CPU). The CPU includes a test point, communication chips and two microprocessors, for example an INTEL8032 and an INTEL80286 which are used for memory storage, communication with other dedicated microprocessors within the apparatus 10, and for controlling all other functions of the apparatus 10 that are not controlled by a dedicated microprocessor. The second microprocessor of the CPU, for example the INTEL80286 includes ROM, RAM and one-time programmable PROMS. The RAM is expandable. It includes programmable features, and is used for temporary storage of information generated by the CPU for machine control.

Still referring to FIGS. 1 and 2, the transfer drum or roller 40 of the present invention includes a second friction drive system 82 for actively and independently driving the transfer roller 40 at a desired active velocity V2 during image transfer. As opposed to slave driving the transfer drum 40 off of the image-bearing member 12, actively driving it with the drive system 82 ensures that the length of all images being transferred will be the same, particularly of color separation images being registered with one another. As shown, the drive system 82 includes a friction drive disk 84 that is mounted fixedly to the roller or drum 40 for rotation therewith. The system 82 also includes a second DC servo motor assembly comprising a second DC motor 86 for driving the disk 84, a second encoder 88 mounted to the motor 86. A second servo controller 90 is connected to the encoder 88 and to the motor 86 for maintaining the RPM and hence velocity of the motor 86 at a desired constant. As further shown, the servo controller 90 is in turn connected to the LCU 80 for monitoring and control. For example, such connection allows for altering the desired constant velocity or RPM of the servo motor 86.

According to the present invention, control means shown generally as 100 are provided for ensuring a matching of the active velocity V2 of the image-receiving surface 92 of the transfer drum 40 to the process velocity V1 of the image-transferring surface of the member 12. The active V2 is the velocity imparted to the member 40 by the active second friction drive system 82. The control means 100 includes active means such as a solenoid assembly 102 that is connected to the motor 86 and to the LCU 80 (FIG. 2) for selectively engaging and disengaging the second servo motor 86 relative to the transfer drum 40. The means 100 also includes a second encoder 104 that is mounted to the transfer drum 40 for movement therewith, and connected to the LCU 80 for measuring the movement thereof in terms of a first series of encoder counts C1. The encoder 104 is mounted such that its index shown as 108 is aligned and always in phase with an index shown as 110 on the drum 40. The drum index 110, for example, may represent a starting point for image transfer to the receiving surface 92. The control means 100 further comprises means 112 for achieving passive driving of the member 40. The means 112 include, for example, a solenoid assembly 114 for moving the image-bearing member 12 into friction drive inducing engagement with the surface 92 of transfer drum 40. This engagement should be such that when the servo motor 86 is selectively disengaged from the drum 40, the image-bearing member 12 moving at the desired process velocity V1, will frictionally drive the drum 40 at such process velocity V1 during a non-image transferring movement. With the drum 40 being driven, as such, a control means adjustment to the active velocity V2 of the drum 40 (if necessary) can be determined and then effected by the LCU 80 for an image transferring movement of the members 12 and 40.

Figure 3:
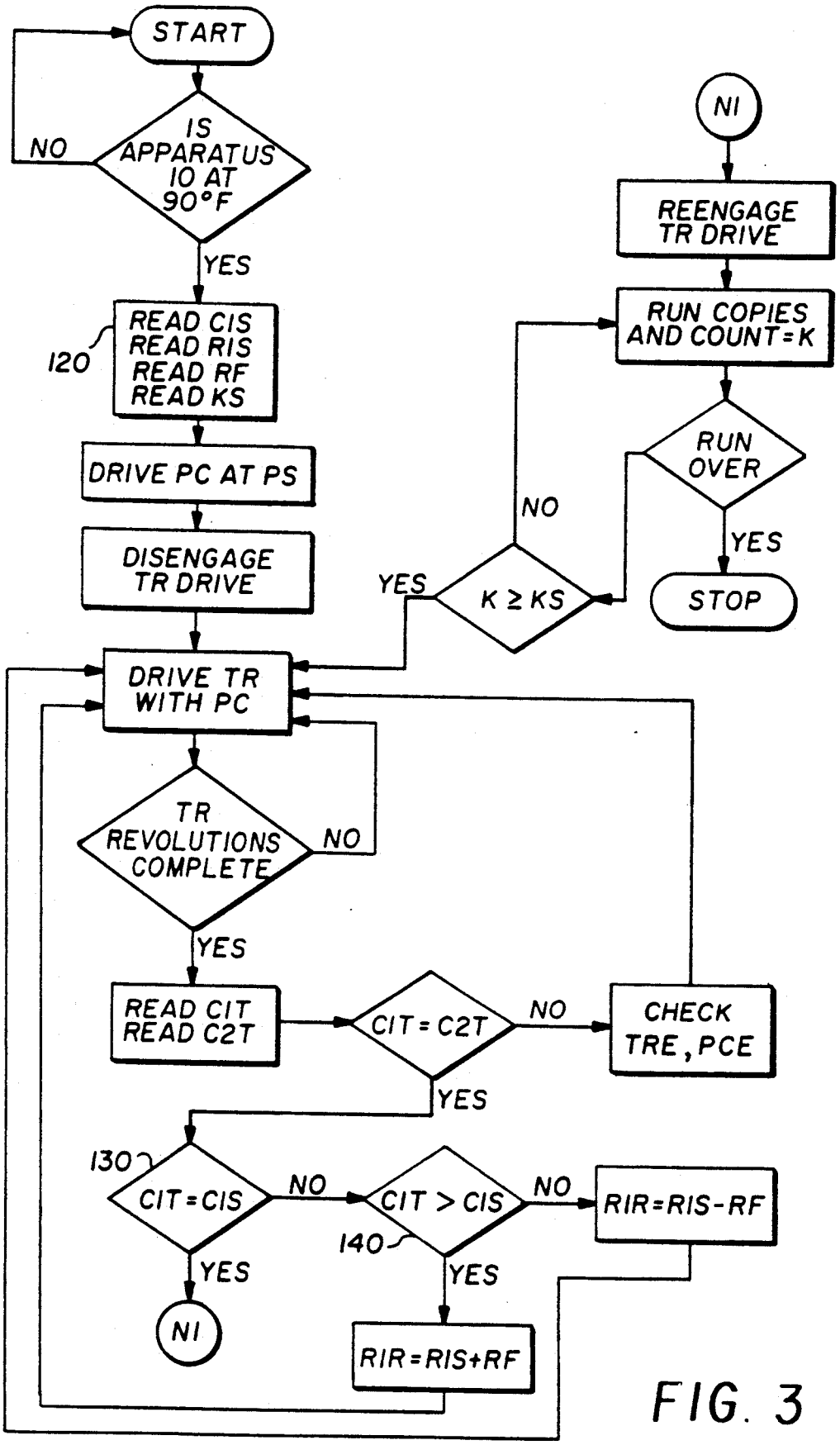
FIG. 3 is a logic flow chart of the method the present invention.

Referring to FIG. 3, in order to determine and effect such an adjustment, the method of the present invention using the control means 100 including the LCU 80 and the first encoder 72 is illustrated. Initially, the method involves checking the minimal operating temperature of components such as the image-bearing member 12, and transfer drum 40 of the reproduction apparatus 10 in order to minimize the risk subsequent thermal expansion of such components following the adjustments of the present invention. Next, it involves reading a series of control data standard points as shown for example in Box 120. Such standard data points may include (a) C1S which is the standard number of counts of the encoder 104 per revolution of the member 40 for the normal or unchanged diameter of the member 40 when being moved or driven at a desired process speed V2 that is equal to V1; (b) R1S which is the standard RPM's of the servo motor 86 at C1S; and (c) RF which is a reset factor for the drive of the member 40, where RF is measured for example in fractions of an RPM of the motor 86 per count C1 of the encoder 104. In addition, another standard KS which is a recurring readjustment check point, in terms of numbers of copies run, is built into the method of the present invention. For example, the adjustment can be carried out at the completion of a standard number KS of copies, for example, 500 copies.

The method of this invention then involves driving the image-bearing member 12 using the drive system 60 at a desired and constant process velocity V1 for example of 11"/sec (eleven inches per sec.). The second DC servo motor 86 is disengaged by means 102 from the transfer member 40, and the member 12 is moved as above by means 112 into friction driving engagement with the transfer member 40 (that is, with the member 12 still being driven at the process velocity V1). At the trigger, for example, of the encoder index 108 (and hence of the transfer drum index 110) the rotational movement of the surface 92, against the member 12, is measured in actual encoder pulses or counts C1T by the second encoder 104. The equivalent movement of the member 12 during such movement of the surface 92 may also be measured by the encoder 72 in terms of a series of pulses or counts C2T of such encoder 72. Such movement of the surface 92 for example can be limited to a single complete revolution thereof, or it may be extended to several complete revolutions, in order to achieve an averaging and greater accuracy in establishing the actual encoder counts, C1T per revolution of member 40.

In order to ensure the proper functioning of the encoders, the actual count C1T of encoder 104 may be compared with that C2T of the encoder 72 (Box 130), and if not equal, should result in a built-in internal checking and for example recalibration of the encoders 72 and 104. Normally, however, the two actual counts C1T and C2T should be equal for each revolution of member 40. More importantly, the actual per revolution count C1T of the encoder 104 is compared with the standard per revolution count C1S of the same encoder in order to determine if due to changes in the environmental parameters (e.g. temperature and relative humidity) the diameter and hence circumference of the drum 40 had changed during use. As shown, if the actual count C1T is equal to the standard count C1S, then the run RPM (R1T) should be and is equal to the standard RPM (R1S). As such, the RPM of the servo motor 86 if left unchanged from standard, and re-engages the drum 40 for actively driving it at R1S. Copies are then run as described above with the drum 40 and member 12 being independently driven by the motors 86 and 64, respectively. A total K of copies being run is kept and compared to the check point count KS thereof for repeating the diameter and adjustment checks for the member 40 as above.

However, if the actual count C1T and the standard count C1S are not equal, then as shown in boxes 140, 150 and 160, an adjustment according to the present method is made to the RPM of the motor 86. For example, where C1T is greater than C1S, a positive adjustment using RF for each excess count is made to the standard R1S of motor 86. If C1T on the other hand is less than C1S, then the reverse is true. As shown, the method of the present invention requires a recheck for equality between C1T and C1S following each such adjustment prior to running copies as above.

Further to the present invention, a thickness factor of 0.003 in. for a 16# paper copy sheet, and 0.006 in. for the transferring height of the toner particles forming the image, are added to a calculated actual diameter of the drum 40 at C1T. Such an actual diameter can, of course, be calculated by the LCU from the actual count C1T as compared to standard count C1S at standard diameter. The adjusted actual encoder count C1T' is then used the same as C1T was above in order to adjust the run RPM (R1T) of the servo motor 86 to where it will drive the toner surface on the sheet CS on the member 40 at a velocity V2 that is equal to process velocity V1.

As can be seen, a reproduction apparatus 10 including a flexible image-bearing member 12 has been provided in which high quality image transfer is achievable because fluttering of the member 12 is significantly reduced, and the velocity V2 of the image receiving surface 92 (and of 92 plus sheet and toner) is adjustably matched during image transfer to the desired process velocity V1 of the image transferring surface of the image-bearing member 12.

The invention has been described in detail with particular reference to a presently preferred embodiment, but it will be understood that variations and modifications can be effected within the spirit and scope of the invention.

What is claimed is:

1. An electrostatographic reproduction apparatus comprising:

(a) a movable image-bearing member having an image-bearing first surface;

(b) means, including a first DC servo motor, for moving said imaging member at a desired process velocity V1;

(c) transfer means, including a movable transfer member having a second surface in transfer relation with said first surface, for transfer-receiving toner images from said first surface;

(d) active means, including a second servo motor, for moving said transfer member independently during an image transfer period at an active velocity V2 relative to said first surface; and (e) means, effective during an image non-transfer period, for controlling the active velocity V2 of said second surface such that it is equal to the process velocity V1 during said image transfer period, said controlling means including:

(i) means for engaging and disengaging said second servo motor relative to said transfer member;

(ii) a first encoder mounted on said transfer member for measuring movement of said transfer member in terms of first encoder counts;

(iii) a second encoder, mounted on said moving means of said image-bearing member, for measuring movement of said image-bearing member in terms of second encoder counts;

(iv) control means, including a logic and control unit connected to said first and second encoders and to said second servo motor, for monitoring and controlling the operations thereof; and (v) means for enabling said image-bearing member to move said transfer member at said process velocity V1 during said image non-transfer period when said second servo motor is disengaged from said transfer member.

2. An electrostatographic reproduction apparatus comprising:

(a) an image-bearing member having an image-bearing surface, said image-bearing member being movable along a closed path;

(b) means for forming a toner image of an original on said image-bearing surface;

(c) means, including a drive roller having a first encoder producing a first series of counts, and a constant velocity servo motor connected to said drive roller, for moving said image-bearing surface at a desired process velocity V1 about said closed path;

(d) an image transfer station located along said closed path including a rotatable transfer member having an image-receiving surface thereon for receiving said toner image, in registration, from said image-bearing surface during an image transferring period; and (e) active drive means for rotating said transfer member independently of said image-bearing member during said image transferring period such that said image-receiving surface thereon is moving at a velocity V2 that is the same as that V1 of said image-bearing surface during said image transferring period, said active drive means including:

(i) a second encoder producing a second series of encoder counts;

(ii) a second DC servo motor for rotating said transfer member;

(iii) means for engaging and disengaging said second servo motor relative to said transfer member; and (iv) control means, including a logic and control unit connected to said first and second encoders and to said second servo motor, for controlling the output thereof; and (f) means, including said image-bearing member, for selectively driving said transfer member frictionally with said image-bearing member during an image non-transferring period when said second servo motor is disengaged from said transfer member.

3. A method for matching a velocity V2 of an image-receiving surface of a transfer member to a process velocity V1 of the image-transferring surface of an image-bearing member during an image transfer period in an electrostatographic reproduction apparatus, the method comprising the steps of:

(a) driving the image-bearing member at the process velocity V1;

(b) disengaging the transfer member from a DC servo motor drive thereto;

(c) engaging the surface of said transfer member and driving said transfer member frictionally with said image-bearing member;

(d) measuring in actual encoder counts the movement of the surface of said transfer member with an encoder mounted thereto;

(e) comparing said actual encoder counts against a standard number of counts of such encoder for a standard unchanged diameter of the transfer member;

(f) adjusting the RPM of said DC servo motor of the transfer member responsively to a difference between said actual and standard counts of such encoder;

(g) re-engaging the transfer member with the adjusted servo motor; and (h) actively and independently driving the transfer member and the image-bearing member during image transfer periods.

4. The method of claim 3 including the additional steps of;

(a) counting the number of image transfers over a period of time;

(b) comparing such count against a preset number of image transfers for such period of time; and (d) repeating steps (a)–(h) when such count exceeds the preset number.

5. The method of claim 3 wherein said transfer member is a drum and the movement of said transfer member is a rotation through at least one complete revolution.

6. The method of claim 5 wherein following the step of measuring in actual encoder counts the rotation of the transfer member, the method includes the following additional steps:

(a) calculating a diameter for said transfer member from the actual number of counts per revolution;

(b) adding a thickness factor to said calculated diameter for the thickness of a copy sheet and of the toner forming the images in order to determine an image-transfer surface diameter; and (c) adjusting the number of actual encoder counts to reflect such an increase in diameter.

7. An electrostatographic reproduction apparatus comprising:

(a) a flexible image-bearing member having an image bearing surface, said image-bearing member being movable along a closed path;

(b) a charging station for charging said image-bearing surface by placing a uniform layer of electrostatic charge thereon;

(c) an exposure station including means for imagewise discharging portions of said charged surface to form latent electrostatic images;

(d) means for developing the latent images using toner particles;

(e) a transfer station including a transfer member having an image-receiving surface for receiving the toner developed images from said image-bearing surface;

(f) a plurality of rollers defining said closed path of said image-bearing member, said plurality of rollers including an exposure roller at said exposure station, a transfer roller at said transfer station and a drive roller positioned therebetween for frictionally driving said image-bearing member; and (g) a first friction drive system for driving said drive roller, said drive system including:

(i) a friction drive disk mounted fixedly to said drive roller of said image-bearing member for rotation therewith;

(ii) a DC servo motor assembly including an encoder and a friction drive pin of said servo motor for driving said drive roller through said drive disk; and (iii) load means for biasing said drive pin of said servo motor against said drive disk of said drive roller.

8. The reproduction apparatus of claim 7 wherein said transfer station includes a second friction drive system for driving said transfer member, said second drive system being substantially the same as said first drive system.

9. The reproduction apparatus of claim 7 wherein closed path positions of said exposure roller, of said drive roller, of and said transfer roller during image transfer are fixed.

10. The reproduction apparatus of claim 7 wherein the circumference of said drive roller is made substantially equal to the sum of intrack dimensions of an image frame segment and an interframe segment adjacent to said image frame on said image-bearing member.

* * * * *